US006286275B1

(12) United States Patent
Edwards

(10) Patent No.: US 6,286,275 B1
(45) Date of Patent: Sep. 11, 2001

(54) WORKSPACE WALL SYSTEM WITH ELEVATED RACEWAY

(76) Inventor: John R. Edwards, 36 Greenside Drive, Nobleton, Ontario (CA), L0G 1N0

( * ) Notice: Subject to any disclaimer, the term of this patent is extended or adjusted under 35 U.S.C. 154(b) by 0 days.

(21) Appl. No.: 09/324,711

(22) Filed: Jun. 3, 1999

(30) Foreign Application Priority Data

Jun. 22, 1998 (CA) ..... 2241289

(51) Int. Cl.[7] ..... E04C 2/30

(52) U.S. Cl. ..... 52/238.1; 52/239; 52/220.2; 52/220.7; 52/302.3; 52/36.1

(58) Field of Search ..... 52/238.1, 220.1, 52/220.2, 220.5, 220.7, 239, 302.3, 28, 36.1, 481.2

(56) References Cited

U.S. PATENT DOCUMENTS

| | | |
|---|---|---|
| 3,471,629 | 10/1969 | O'Leary . |
| 4,219,101 | 8/1980 | Valsvik . |
| 4,241,777 | 12/1980 | Wenger . |
| 4,351,475 | 9/1982 | Hudson . |
| 4,535,577 | 8/1985 | Tenser et al. . |
| 4,685,255 | 8/1987 | Kelly . |
| 4,716,698 | 1/1988 | Wilson et al. . |
| 4,835,915 | 6/1989 | Nilssen . |
| 4,942,805 | 7/1990 | Hellwig et al. . |
| 4,949,490 | 8/1990 | Miller . |
| 5,025,603 | 6/1991 | Johnson . |
| 5,038,539 | 8/1991 | Kelly et al. . |
| 5,058,347 | 10/1991 | Schuelke et al. . |
| 5,207,041 | 5/1993 | Wills . |
| 5,209,035 | 5/1993 | Hodges et al. . |
| 5,277,007 | 1/1994 | Hellwig et al. . |
| 5,299,947 | 4/1994 | Barnard . |
| 5,322,473 | 6/1994 | Hofstra et al. . |
| 5,341,615 | 8/1994 | Hodges et al. . |
| 5,394,658 | 3/1995 | Schreiner et al. . |
| 5,403,232 | 4/1995 | Helm et al. . |
| 5,406,760 | 4/1995 | Edwards . |
| 5,433,046 | 7/1995 | MacQuarrie et al. . |
| 5,487,246 | 1/1996 | Hodges et al. . |
| 5,511,348 | 4/1996 | Cornell et al. . |
| 5,638,650 | 6/1997 | Edwards . |
| 5,813,178 | 9/1998 | Edwards . |

FOREIGN PATENT DOCUMENTS

| | | |
|---|---|---|
| 0456421 | 5/1991 | (EP) . |

*Primary Examiner*—Christopher T. Kent
*Assistant Examiner*—Jennifer I. Thissell
(74) *Attorney, Agent, or Firm*—Riches, McKenzie & Herbert

(57) ABSTRACT

A workspace management system comprising a wall for dividing a room into separate work areas, wherein the wall extends vertically and in a longitudinal direction, the wall having a first side surface, a second side surface, a lower portion and an upper portion above the lower portion, the upper portion having a width defined between the first and second side surfaces over the upper portion greater than a width of the lower portion defined between the first and second side surfaces over the lower portion, an overhead raceway defined within the upper portion between the first surface and the second surface over the upper portion, the overhead raceway extending longitudinally of the wall.

20 Claims, 9 Drawing Sheets

WORKSPACE WALL SYSTEM WITH ELEVATED RACEWAY

FIELD OF THE INVENTION

This invention relates to workspace wall systems for dividing of rooms into separate work areas and, preferably, for such wall systems having a rigid framework formed of upright partitions joined together.

BACKGROUND OF THE INVENTION

It is known to divide open office spaces into separate work areas by providing a series of interconnected walls. The walls frequently do not extend the full height to the ceiling of the room. The walls may preferably comprise part of a wall system formed of a plurality of preferably rigid rectangular frames or partitions rigidly joined together. Known workspace wall systems utilize utility panels or partitions which, preferably, are modular. Preferred such workspace wall systems and partitions therefore are taught in the following U.S. patents:

U.S. Pat. No. 4,535,577 to Tenser et al, issued Aug. 20, 1985;

U.S. Pat. No. 4,685,255 to Kelly, issued Aug. 11, 1987;

U.S. Pat. No. 5,209,035 to Hodges et al, issued May 11, 1993;

U.S. Pat. No. 5,277,007 to Hellwig et al, issued Jan. 11, 1994;

U.S. Pat. No. 5,394,658 to Schreiner et al, issued Mar. 7, 1995; and

U.S. Pat. No. 5,638,650 to Edwards, issued Jun. 17, 1997.

Each of these patents teaches a partition of substantially constant width throughout its height and various mechanisms to accommodate passageways therethrough for the transfer within the interior of the partition of utilities including electrical conduits, communication conduits and other similar wiring and cabling as well as other forms of utilities such as heating and air conditioning ducts and fluid pipes for water, cooling gases, fuels and the like. Utility panel systems such as those taught in U.S. Pat. No. 5,209,035 to Hodges et al provide some partitions with an increased width throughout their height as compared with other partitions so as to provide increased width raceways or utility troughs throughout the length of each wider utility panel.

The present inventor has appreciated a difficulty with such previously known systems that the width of the partition dictates, to a large measure, the space available for a raceway and that increasing the width of a partition throughout its height, disadvantageously increases the floor area occupied by the partition.

Another disadvantage appreciated by the present inventor is that with many known workspace wall systems where the walls do not extend to the ceiling of the workspace, sound readily carries over the top of the walls.

SUMMARY OF THE INVENTION

To at least partially overcome these disadvantages of previously known devices, the present invention provides a workspace management system with walls having an upper portion of increased width. To overcome other disadvantages of previously known devices, the present invention provides walls for a workspace wall system in which the wall extends inwardly at an upper portion of the wall to assist in preventing sound from passing over the wall.

Accordingly, in one aspect, the present invention provides a workspace management system comprising a wall for dividing a room into separate work areas wherein the wall extends vertically and in a longitudinal direction, the wall having a first side surface and a second side surface with a width of the wall defined between the first and second side surfaces, the wall having a lower portion and an upper portion above the lower portion, the width of the wall over the upper portion being greater than the width of the wall over the lower portion, an overhead raceway defined within the upper portion between the first surface and the second surface, the overhead raceway extending longitudinally of the wall.

DETAILED DESCRIPTION OF THE DRAWINGS

Further aspects and advantages of the present invention will become apparent from the following description taken together with the accompanying drawings in which.

DETAILED DESCRIPTION OF THE DRAWINGS

Figure 1:
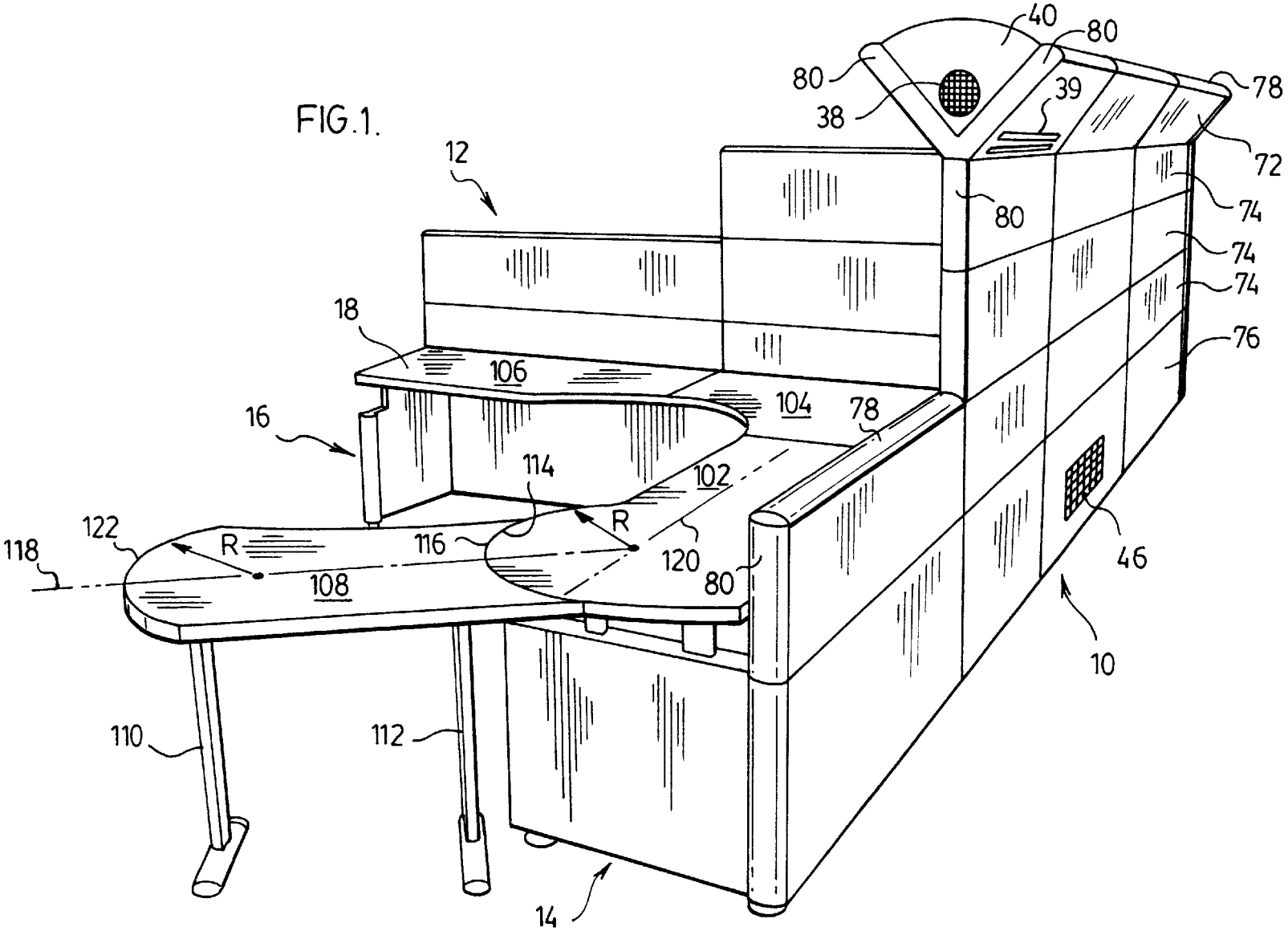
FIG. 1 is a pictorial view of a workspace management system in accordance with a first embodiment of the present invention.

Reference is made first to FIG. 1 which shows a portion of a workspace management system in accordance with a first embodiment of the present invention. The management system comprises a first wall 10, a second wall 12 and two partial shorter walls 14 and 16. Each of the walls 10, 12, 14 and 16 are fixedly connected to each other at their ends. A desk 18 is shown supported by portions of each of the walls 10, 12, 14 and 16.

Figure 2:
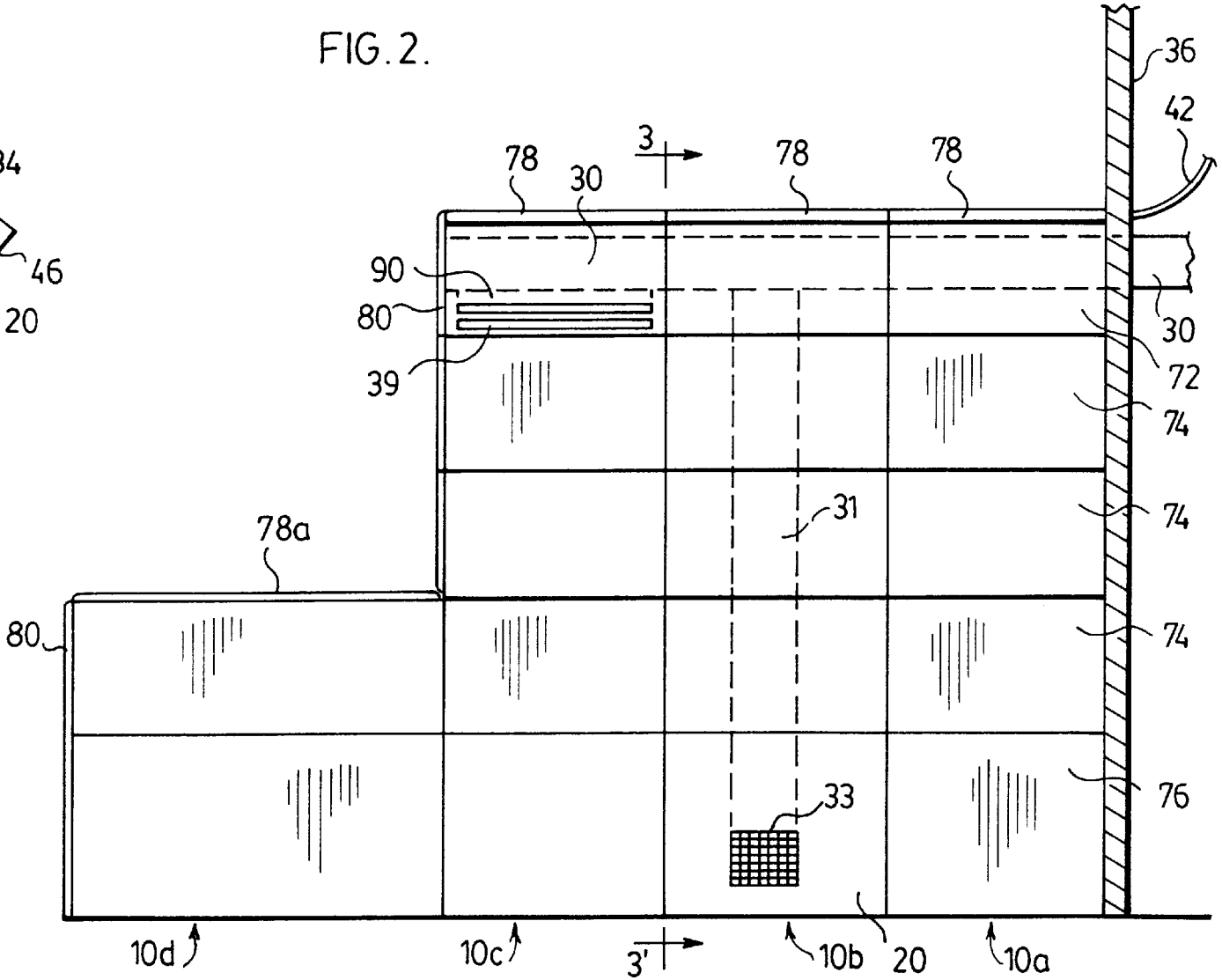
FIG. 2 is a side view of the embodiment shown in FIG. 1 also showing a permanent end wall in cross-section.
Figure 3:
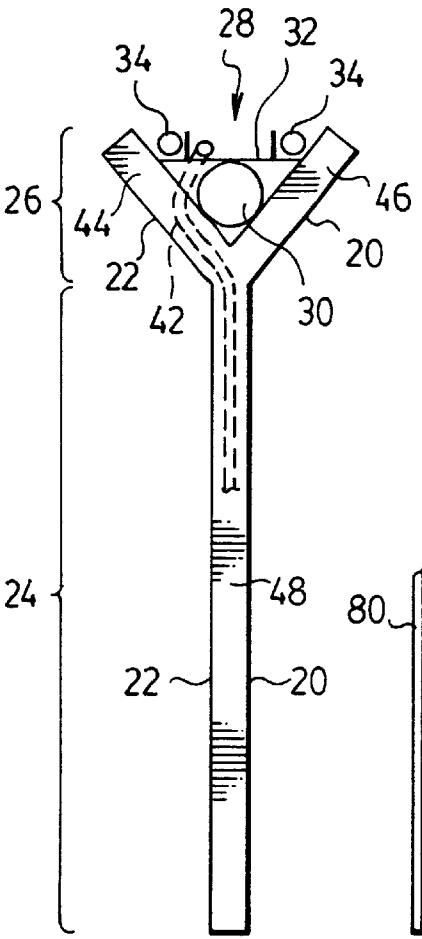
FIG. 3 is a schematic end view along line 3–3' in FIG. 2.

As seen in FIG. 3, the wall 10 has a first side surface 20 on one side and a second side surface 22 on the other side with the width of the wall at any height being referred to as the distance between the side surfaces 20 and 22. As seen in cross-section in FIG. 3, the wall 10 has a constant width over a lower portion 24 and an increased width over an upper portion 26. An enlarged overhead raceway 28 is provided in the upper section 26 defined within the space between the side surfaces 20 and 22. The enlarged overhead raceway 28 extends longitudinally along the top of the wall 10 accommodating, as best seen in FIGS. 2 and 3, a duct 30 for movement of air conditioning air, an upwardly opening channelway 32 and upwardly directed light producing units schematically shown as fluorescent lamps 34.

As schematically shown in FIG. 2, with the wall 10 having its right-hand end secured to a permanent wall 36, the duct 30 can extend through the wall and horizontally along the overhead raceway 28 as to, as seen in FIG. 1, an exit grating 38 located in an end cover 40. FIGS. 1 and 2 show exit openings 39 in the form of elongate slots open through the side surface 20 on one side of the raceway which are schematically shown as in communication with the duct 30 via a suitable connecting boot 90. The connecting boot 90 is conveniently within the raceway 28 and a flow control mechanism may be provided in the boot or on the exit openings 39 to permit control of flow. Similarly, the channel 32 can provide a raceway for a cable 42 which may extend through the wall 36 and can be laid into the channel 32 from above, for example, to extend along the channel and then, at some portion, down into the interior of the wall as illustrated in dashed lines in FIG. 3 and, subsequently, vertically and/or horizontally within the individual walls to desired locations. As schematically shown in FIG. 2, a vertical duct 31 can be provided within the wall 10 in communication with the duct 30 to permit communication from the duct 30 to a grate opening 33 shown in the side surface 20 of the wall 10 preferably with a mechanism to control flow.

The embodiment illustrated in FIGS. 1 to 3 shows the enlarged width upper portion 26 as being provided at a height which will not interfere with the intended usage of the area to either side of the wall. Where persons may walk adjacent the wall, preferably, the enlarged width upper portion does not start until about four feet above the floor, more preferably, above five feet or six feet, more preferably, above the normal head height of a typically sized person. Where the wall is adjacent a desk, the enlarged width upper portion may start at a lower height having regard to the height and width of the desk.

The first embodiment preferably shows the side surfaces 20 and 22 over the upper portion 26 as having portions which extend at an angle upwardly and away from the lower portion 24. This is advantageous to assist in reducing the amount of sound which would be transferred over the top of a wall having the same height. For example, by reason of the side surface 22 of the wall extending upwardly and to the left as seen in FIG. 1, some sound produced on the left-hand side of the wall 10 near the side surface 22 will be reflected by the side surface 22 of the upper portion downwardly to the left which sound otherwise would be permitted to pass to the right and vertically up over the wall 10.

The embodiment illustrated in FIG. 1 illustrates the partition as having a generally Y shape in end cross-section with the partition being of uniform thickness and extending upwardly vertically as a vertical post 48 forming the lower portion 24 and then bifurcating or branching into two arms 44 and 46 extending upwardly from the vertical lower portion 24 at uniform angles of about 45° to a vertical.

Figure 4:
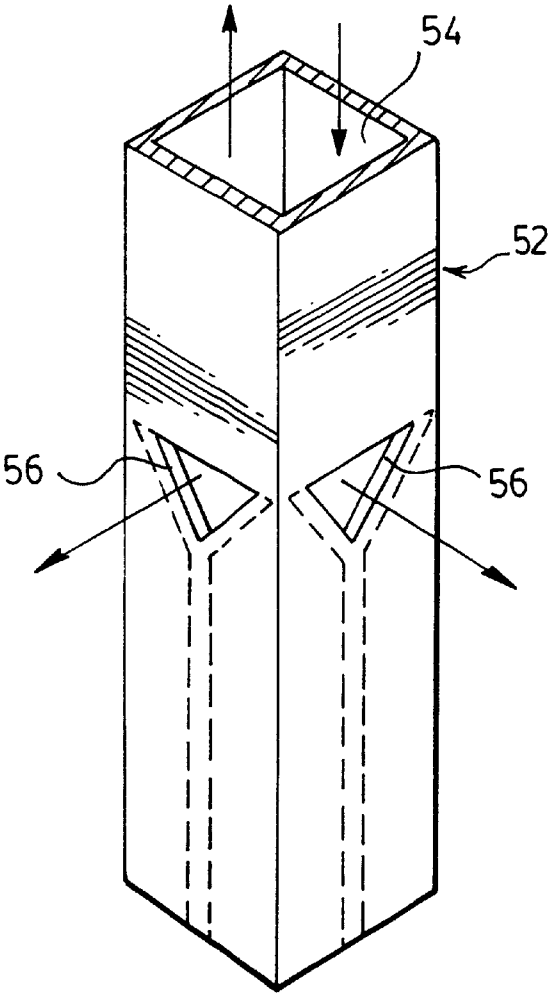
FIG. 4 is a schematic view of a vertical tower adapted for use with a partition as shown in FIG. 1.

Reference is now made to FIG. 4 which schematically shows a vertical tower 52 which could be provided to extend from the floor to the ceiling and provide a convenient vertical raceway 54 for ducting which can then be routed via openings 56 into horizontal ducts such as ducts 30 shown in FIG. 3 to be carried in the overhead raceway 28 of a wall 10 as shown in FIG. 1. FIG. 4 shows in dashed lines, the outline of the ends of a partition of the type shown in FIG. 3 to illustrate the approximate location of the ends of two straight lengths of walls 10 similar to that shown in FIG. 1 where the walls 10 would intersect on two faces of tower 52 and also showing location of the opening 56 which would permit passage of the ducts and other utilities from the overhead raceways 28 into the interior vertical raceway 54 of the tower.

Figure 5:
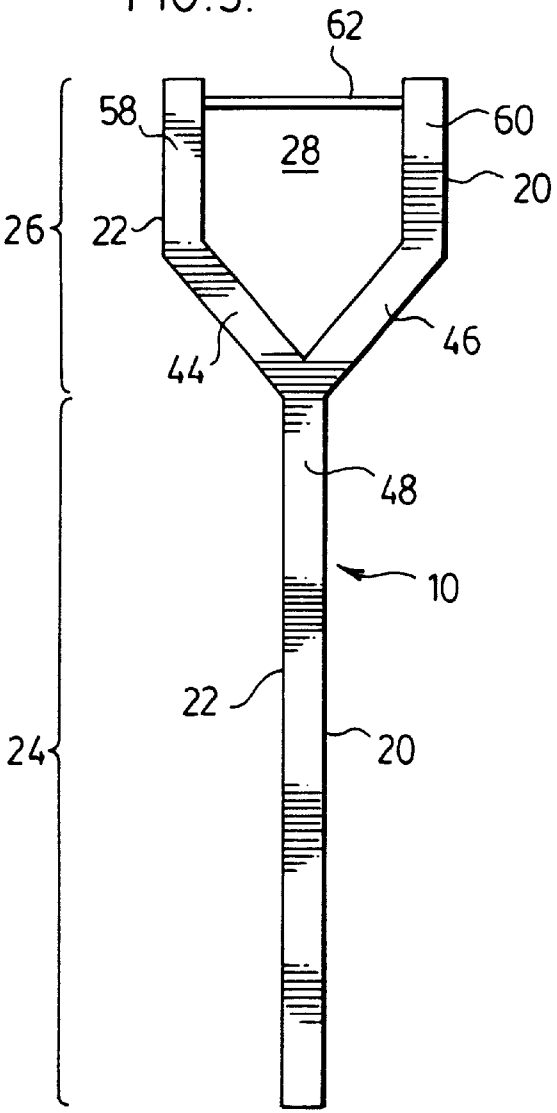

Reference is now made to FIG. 5 which shows a modification of the partition shown in FIG. 1 so as to include in addition to each angled arm 44 and 46 a further vertical arm 58 and 60. Providing the vertical arms 58 and 60 increases the volume of the overhead raceway 28 to permit it to accommodate additional ducting, conduit and the like. FIG. 5 shows an optional removable cross brace 62 extending between the upper ends of the arms 58 and 60. Preferably, the cross brace 62 may be readily removed to permit easy access of additional cable wiring, ducting and the like into the overhead raceway 28.

Figure 6:
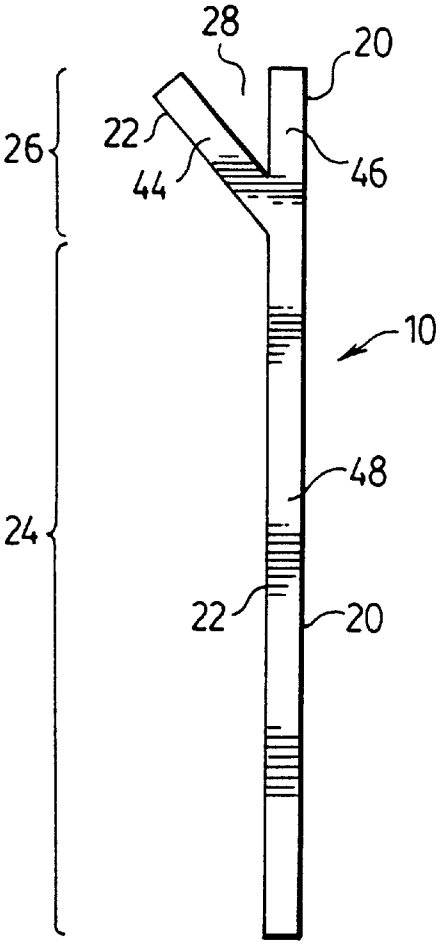
FIGS. 5, 6, 7, 8 and 9 are end views similar to that of FIG. 3, however, of second to sixth embodiments in accordance with the present invention.

Reference is now made to FIG. 6 which illustrates a further modification of the partition shown in FIG. 1 so as to provide the wall 10 as having the arm 46 extend vertically from the post 48 throughout the height of the wall with the depending arm 44 extending at an angle to the left. This configuration has the advantage of providing a continuous vertical wall side surface 20 on the right-hand side which may be advantageous in certain circumstances yet provides sound reducing effects on the left-hand side and provides the raceway 28.

Figure 7:
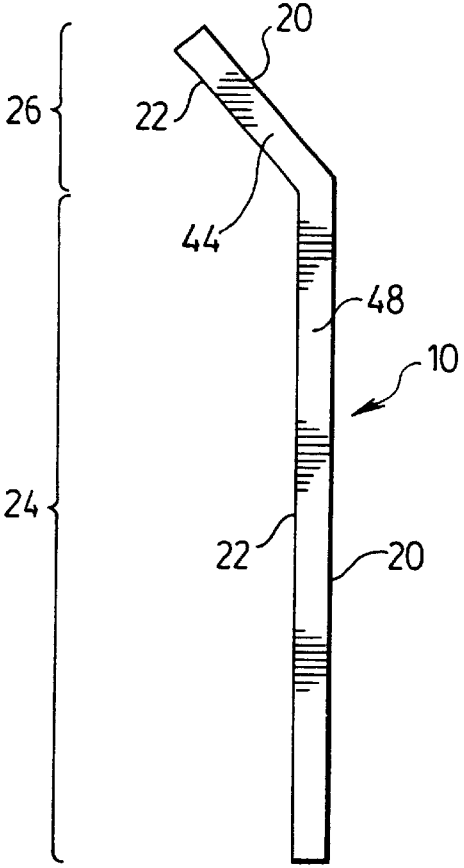

Reference is now made to FIG. 7 which shows a further embodiment of the partition shown in FIG. 1 in which merely one arm 44 is provided at the top of post 48 so as to assist in maintaining sound to the left-hand side of the wall 10 yet without providing the overhead raceway 28.

Figure 8:
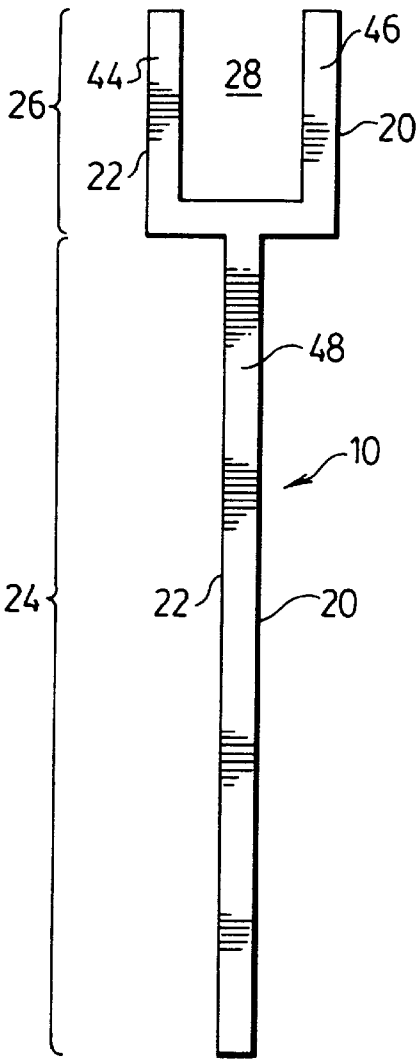

Reference is now made to FIG. 8 which shows a cross-sectional end view of another configuration of the partition in which the arms 44 and 46 extend horizontally from the upper end of the post 48 and then vertically upwardly.

Figure 9:
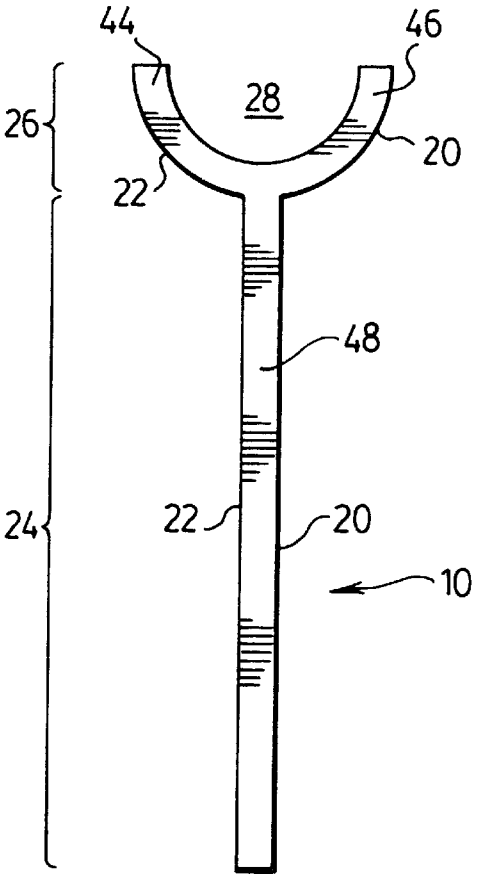

FIG. 9 shows another cross-sectional end view of a further embodiment of a partition in which the arms 44 and 46 include curved portions and present the surfaces 22 and 20 at least in part directed downwardly. Of course, the arms 44 and 46 could use a combination of curved and straight portions.

The walls 10 in accordance with the present invention may be constructed in many known manners. For example, the walls could be of a permanent construction. Preferably, however, the walls are constructed from prefabricated modular wall partitions such as those taught in any of the above-noted U.S. Pat. Nos. 4,535,577; 4,685,255; 5,209,035; 5,277,005; 5,394,658 and 5,638,650. In this regard, as seen in FIGS. 1 and 2, the wall 10 preferably is formed of individual partitions indicated as 10*a*, 10*b*, 10*c* and 10*d* with each partition representing a rigid rectangular frame comprising vertical frame members and horizontal frame members to which covers are secured, preferably, for easy removal to access vertical and horizontal raceways underneath the covers in the interior of each partition.

Most known modular wall partitions incorporate mechanisms whereby a partition of a fixed height can have additional partition frame members secured to its top as, for example, where a hollow vertical base post is utilized as a vertical frame member, a post extension may be telescopically received within the base vertical post. Therefore, the new overhead raceway 28 of this invention is readily adapted for addition or retrofitting onto existing wall systems without the need to modify the underlying wall systems and will provide a convenient and significant overhead raceway for carrying conduit cabling and the like of substantial size.

The fact that the arms 44 and 46 adopt a symmetric configuration, assists in stabilization of a resultant wall 10. In any event, with the wall 10 and other walls 12, 14 and 16 secured to the wall 10 and extending normal thereto as is common and/or with the end of the wall 10 secured to the wall 36, a preferred wall system as shown in FIG. 1 would be stable and could carry relatively substantial loading in the overhead raceway 28 without difficulty having regard to the nature of the design, strength and structural integrity of the partitions.

The particular partition system selected preferably would have openings from the overhead raceway 28 vertically down into the interior of the partitions and from the interior space of one partition to the interior space of other partitions in a known manner. Preferably, the covers for the partitions are removable, to assist in laying in of wiring conduit and the like.

Figure 10:
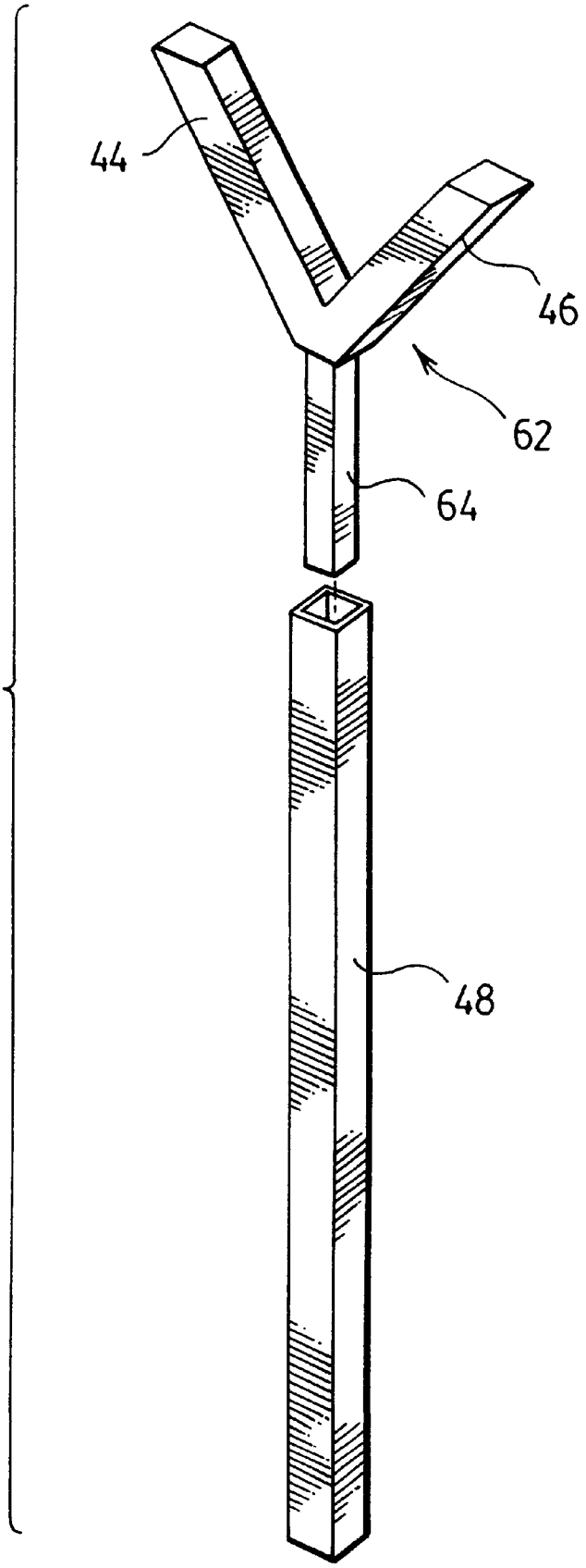
FIG. 10 is an exploded view of a construction of a Y-shaped vertical post for a partition in accordance with the present invention.
Figure 11:
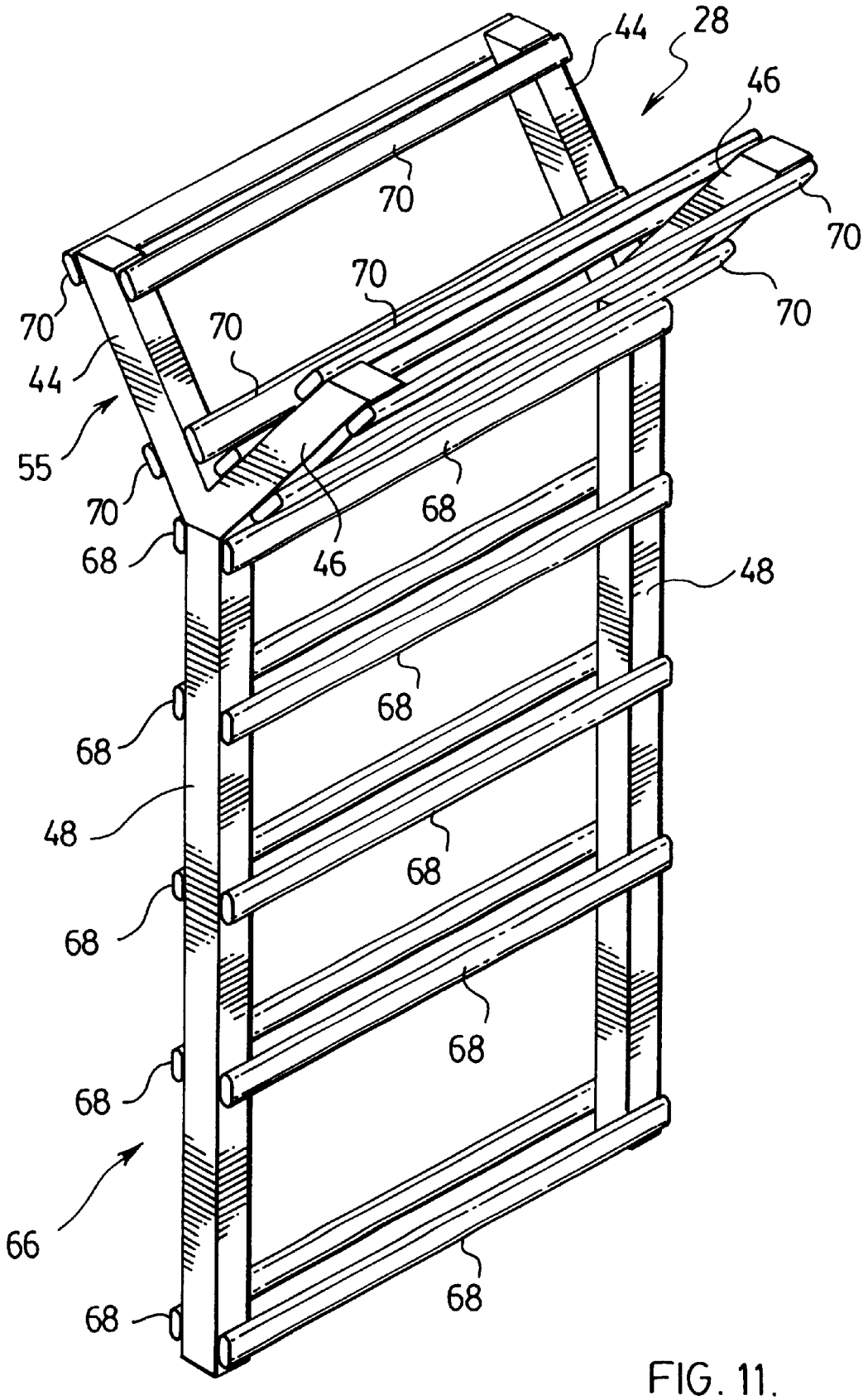
FIG. 11 is a pictorial view of a frame for a partition in accordance with the present invention.
Figure 12:
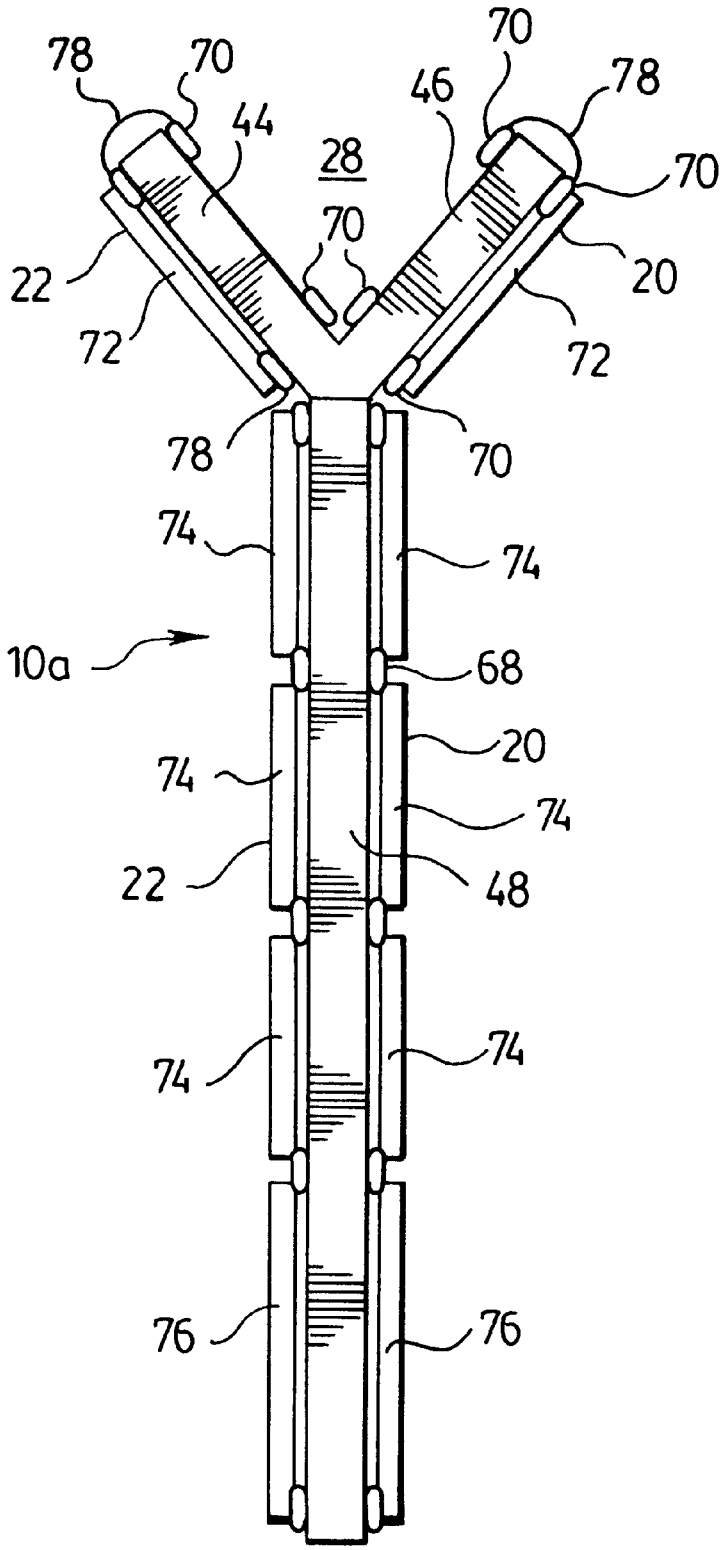
FIG. 12 is an end view of a complete partition in accordance with the present invention utilizing the frame shown in FIG. 11.

Reference is now made to FIGS. 10, 11 and 12 which show elements of a partition in accordance with the present invention comprising a modification of a partition of the type illustrated in U.S. Pat. Nos. 5,406,760; 5,638,650 and 5,813,178, the disclosures of which are incorporated herein by reference.

FIG. 10, which shows a Y-shaped extension member 62 carrying arms 44 and 46 and having a third arm 64 adapted to be telescopically secured in hollow vertical post 48 of the type disclosed in U.S. Pat. No. 5,638,650.

FIG. 11 shows an end view of a frame 66 for the partition 10*a* in FIG. 1 having a vertical hollow post 48 into which the arm 64 (not shown) of the Y-shaped extension member 62 is secured. In a normal manner as taught by U.S. Pat. No. 5,638,650, which is incorporated herein by reference, the vertical post 48 carries horizontal beams 68 thereon secured to opposite sides of the vertical post 48 in pairs. The arms 44 and 46 preferably having a cross-sectional shape identical to that of the vertical post 48 and similar horizontally extending beams 70 are provided on the arms 44 and 46, preferably, at the upper end and the lower end of each of the arms 44 and 46. Horizontal beams 70 on the inside surfaces of the arms 44 and 46 increase the overall rigidity of the structure, although are not necessary.

The end cover 40, shown in FIG. 1, can comprise a simple sheet of sheet metal or plastic readily secured between the arms 44 and 46 and, in this case, cut away to carry a suitable grate 38 as shown.

FIG. 12 shows an end view of the partition 10*a* of FIG. 1 utilizing the frame 66 of FIG. 11. As shown, removable covers 72, 74 and 76 are provided secured to each side of the frame. Preferably, each cover 72, 74 or 76 extends between adjacent spaced beams 68 or 70 on one side and are removably coupled thereto as taught in U.S. Pat. No. 5,638,650 with clips. Cover 72 is provided to span the beams 70 on the arms 44 and 46 to provide the outer surfaces 20 and 22 over the upper portion 26. Similarly, covers 74 and 76 span the beams 68 on the posts 48.

On each of the arms 44 and 46, the horizontal beams 70 are spaced and located at relative distances such that the cover 72 on each arm 44 and 46 will be sufficiently close to the uppermost cover 74 and/or the uppermost horizontal beam 68 at the top of the upright post 48 as to substantially close the space therebetween.

It is to be appreciated the arms 44 and 46 are preferably to be selected to have a size to permit use of a modular cover 72 of the same size and identical to covers 74 used on other sections, for example, the three uppermost sections of the partition 10*a*. A lowermost cover 76 is shown of a different height.

As seen in FIG. 1, a modular top cap 78 which is normally adaptable for use on the top of a vertical wall such as shown as 78*a* on the top of panel 10*d* is also used in an appropriate length to cover the upper top of each arm 44 and 46. Similarly, as seen in FIG. 1, a modular end cover 80, the same as that shown on the end of an upper portion of partition 10*c*, is used to decoratively cover the end of each arm 44 and 46. Essentially, all the modular components of the system taught by U.S. Pat. No. 5,638,650 are directly adapted for use on the new upper portion 26.

Separate support mechanisms could be provided to bridge across the raceway 28 between the arms 44 and 46 to support ducting and the like therein. However, most ducting will have a sufficient internal rigidity and will contact the arms of the various partitions at sufficient locations to avoid the need for any particular structure to hold the duct work or channel. Of course, the duct work or channel could be secured to the arms 44 and 46 or the horizontal beams 63 about the raceway 28 in any desired manner.

Where lighting, such as lamps 34, is provided within the elevated raceway 28, it may preferably be provided to direct the light upwardly such that light may bounce off the ceiling and provide indirect lighting. Alternatively, one or more of the covers 72 may comprise an opaque or translucent material as, for example, to permit light to pass downwardly therethrough. Any of the covers for the panels including the covers 72 over the arms 44 and 46 could provide vents to permit access or exit of air conditioning air or the like. If desired, individual fan motors or louver control systems could be provided such that a user could individually regulate the amount of air flow which might be provided, for example, to a user's individual workspace.

To provide for air flow from a duct such as duct 30 in the raceway 28 to exit openings 39 as shown in FIGS. 1 and 2, the covers 72 as illustrated in FIG. 12 may be modified to have elongate slots cut or punched therein, particularly where the covers are sheet metal. By punching the slots, the rear of the cover can be provided with flanges for coupling of a boot to connect the slots to ducts within the raceway. Alternatively, a boot from the ducts can be provided to vent air from between the uppermost beam 78 and the lowermost beam 70 and between the covers 72 and 74 on one or both sides of the wall.

Reference is now made to FIG. 1 which shows as another aspect of the present invention an improved desk arrangement. As shown, the desk 18 is shown as comprising sections 102, 104 and 106 supported directly by the walls 10, 12, 14 and 16 and a section 108 which is preferably free standing on legs 110 and 112. Desk section 102 has convex outer edge 114 which is of a constant radius "R".

Desk section 108 has a complementary concave edge 116 which is also of the same constant radius. The circumferential extent of edge 114 is preferably of a greater extent than that of edge 116 such that the desk section 102 can be positioned at different angular orientations relative the desk section 102 yet with the edges 114 and 116 in mated contact. In the embodiment shown, a longitudinal axis 118 of desk section 108 may be disposed to extend between about 90° to about 180° relative a longitudinal axis 120 of desk section 102. For other embodiments, the axis may extend between about 90° and 270°.

Preferably, the desk section 108 may have at an end opposite edge 116 a concave edge 122 of the same radius "R" to permit attachment of two desk sections 108 end to end and to provide a pleasing appearance.

The present invention, therefore, also provides a novel desking arrangement with two desk sections having complementary, radiused edges for complementary abutment over a variety of different angular orientation.

Figure 13:
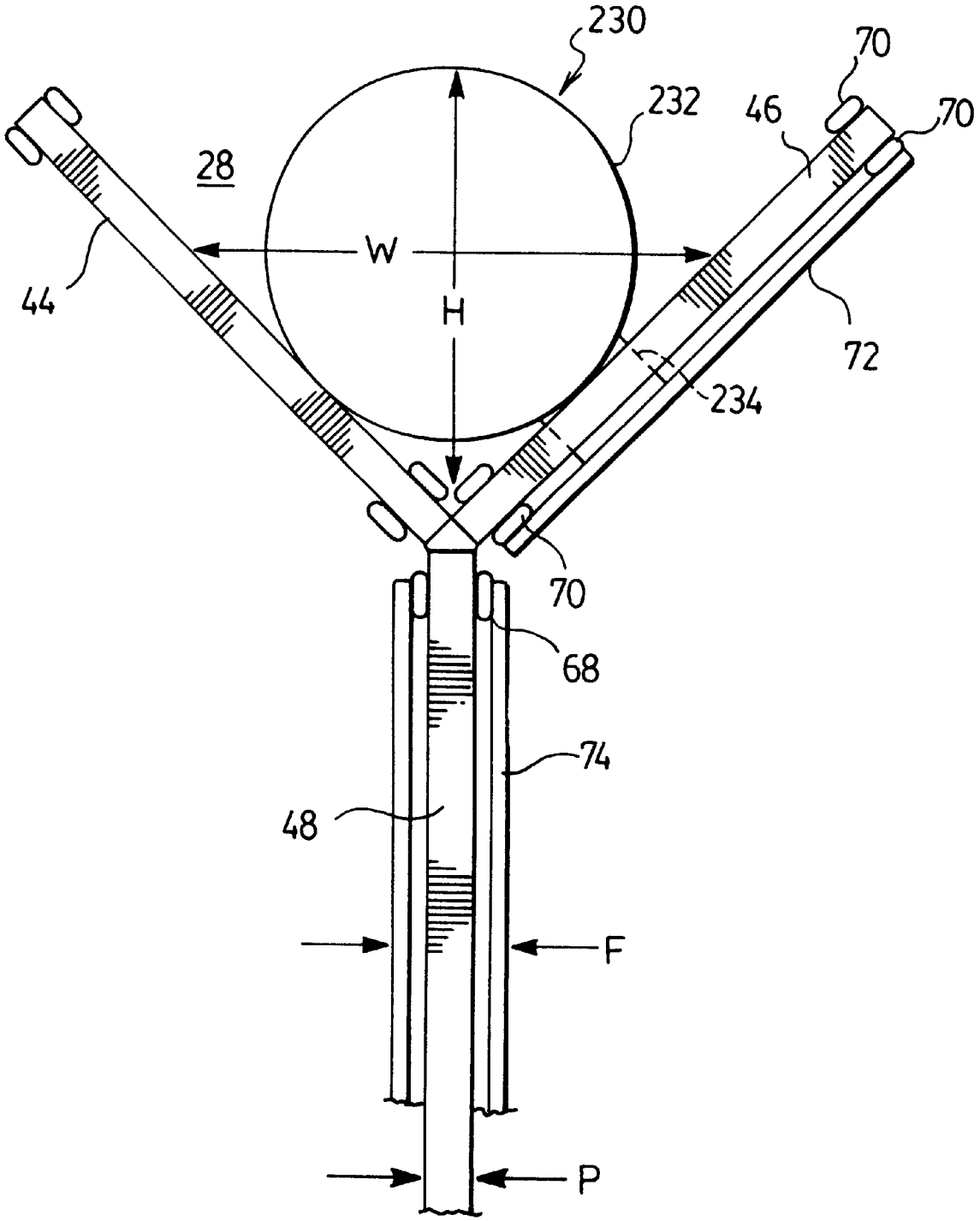
FIG. 13 is an end view of a top portion of a partition in accordance with the present invention similar to that shown in FIG. 12, however, with all but one panel removed and showing a duct element.
Figure 14:
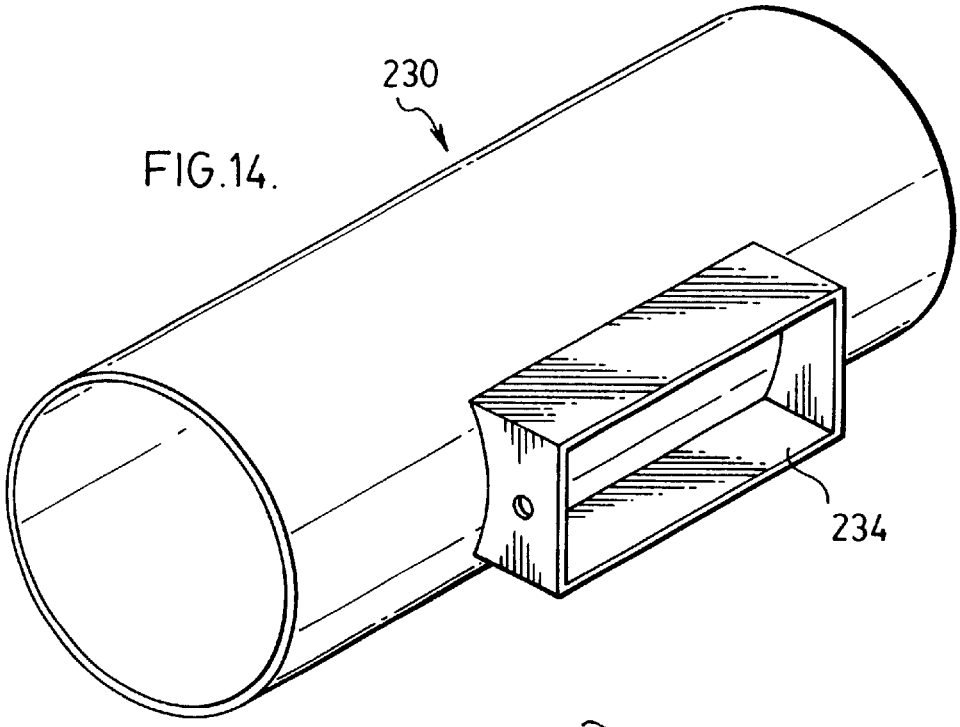
FIG. 14 is a schematic pictorial view of the modular duct element shown in FIG. 13.
Figure 15:
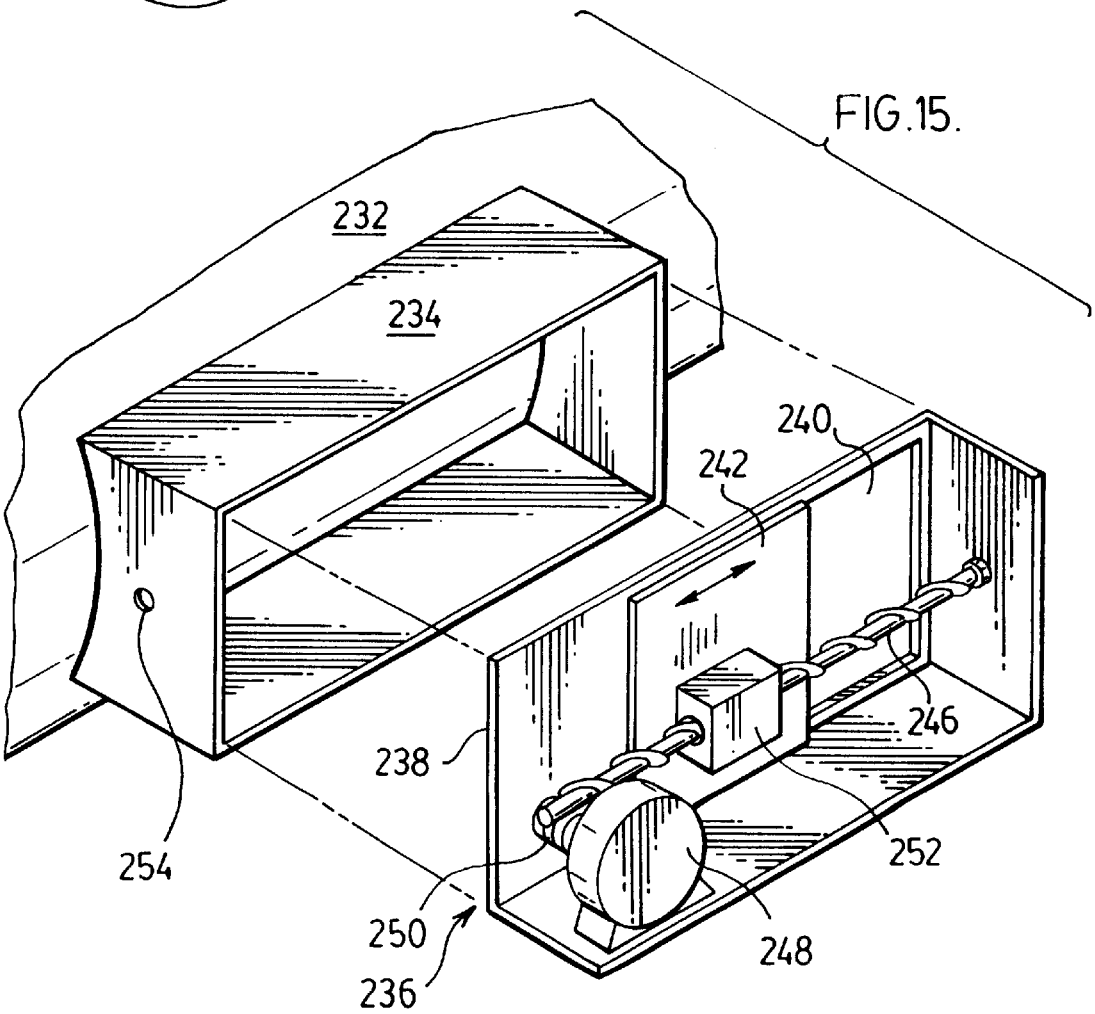
FIG. 15 is a schematic partially exploded view of a damper mechanism adapted to fit into an outlet for the duct element shown in FIG. 14.

Reference is now made to FIGS. 13 to 15 which show an advantageous arrangement for a ducting system to be provided in the raceway 28.

FIG. 13 shows an end view of a top of a partition substantially the same as that shown in FIG. 2, however, illustrated as utilizing arms 44 and 46 each formed from tubular square metal rods of about 2 inch width and 24 inch length. In FIG. 13, only one removable cover 72 is shown. A modular duct member 230 is provided within the raceway 28. The duct member shown is preferably formed from thin sheet metal and would proportionally have a radius of approximately 20 inches. The modular duct member 230 comprises a generally cylindrical tube 232 with a rectangular exit conduit 234 opening from one side thereof FIG. 15 schematically shows in an exploded view, a damper mechanism 236 adapted to be received internally within the exit conduit 234. The damper mechanism is schematically shown as comprising a back plate 238 to close the exit conduit other than where an opening 240 is provided therethrough. A damper plate 242 is provided to move horizontally to open and close the opening to a variable extent. The damper is carried on a threaded rotatable horizontal axle 246 which is journalled at both its ends. An electric motor 248 carries a worm gear 250 to engage and drive the axle 246. The damper plate 242 is carried on the axle 246 by a block 252 which is internally threaded. By rotation of the axle in a controlled manner in one direction or the other, the damper plate 242 is moved to open or close the opening 240. The motor 248 would be powered by electric power and the electric wires and wiring for control could be adapted to be provided to the motor as, for example, through an opening 254 in the exit conduit, the wires being adapted to extend into the interior space of the partition for coupling to suitable control devices. With the conduit 234 carrying pressurized air, the damper mechanism can control release of the air into a worker's own work space as controlled for example by the worker.

As seen in FIG. 13, the exit conduit 234 is provided substantially in the internal space of the partition in the width of the arm 46 and extending outwardly to the inside surface of the panel 72 as, for example, for directing air to an exit vent such as vent 39 shown in FIG. 1.

The modular duct member 230 may preferably be provided in one length and be adapted for use in a partition system having different length partitions. The modular duct member 230 may be provided to have a length sized so as to fit within the partitions of the smallest length to have venting therethrough. The modular duct member 230 preferably is adapted to be coupled as to conventional cylindrical ducting which may be flexible or rigid as by coupling, for example, with the modular duct member 238 to have slightly swayed ends. By providing connecting lengths of a standard circular duct work to be of different lengths, the individual modular elements can be appropriately located within partitions of different lengths, yet with the exit conduits 234 to overlie vents such as 39.

The modular duct members 230 are adapted to place an exit conduit 234 either through arm 44 or arm 46. A suitable damper mechanism can be provided in either case.

Support for the modular duct member 230 is preferably provided by the modular duct member engaging the arms 44 and 46 at each side of a partition and to assist in this purpose, extensions comprising conventional sheet metal ducting can be provided so that for any longer partition, a modular duct member 230 would have an extension at its end which would extend the same to overlie the arms 44 and 46 at each end.

As shown in FIG. 13, the elevated raceway is shown as having a width W measured horizontally between the arms 44 and 46 and a height H measured vertically between the bottom of the raceway 28 and the top of the arms 44 and 46. As seen in FIG. 13, the post 48 is shown to have a horizontal width indicated as P. A fully clad post which includes the post 48 and beam 68 and cover 74 on both of its sides is indicated as having a width indicated as F.

The average width of the elevated raceway can be determined by determining an average of the width W over the height H. Preferably, in accordance with the present invention, the average width of the raceway is at least greater than the width P of the post 48, preferably greater than the width F of a fully clad post, more preferably, greater than twice the width F of the fully clad post, more preferably, greater than three times the width of a fully clad post, more preferably, greater than four times the width of a fully clad post and, preferably, in the range of five times greater than the width of the fully clad post, or greater.

The maximum width of the raceway is also preferably greater than at least twice the width F of a fully clad post, more preferably, at least three times the width F of the fully clad post and, preferably, at least four to ten times the width of the fully clad post.

The average height of the elevated raceway can be determined by determining the average of the height H over the width W. The average height is preferably at least one, two, three, four or five times the width F of the fully clad post or greater.

The maximum height H of the raceway is preferably greater than the width P of the post, more preferably, greater than the width F of a fully clad post, more preferably, greater than twice the width F of a fully clad post and, more preferably, at least three times the width F of a fully clad post and, preferably, at least four to ten times the width F of a fully clad post.

FIG. 13 shows an embodiment with preferred dimensional relationships of the varied elements and, particularly, the posts 48, arms 44 and 46, the beams 68 and 70 and the cover 72. For example, preferred width dimensions for each are in the range of about 1½ inches (3.8 cm) for each of the posts; about 0.5 inches (1.25 cm) for each of the beams and about 0.5 inch (1.25 cm) for each cover. This leads to a total width F of a fully clad post of about 3.5 inches (18.3 cm).

While the relative dimensional relationships of the various elements may be varied, it is to be appreciated that in accordance with the present invention, the raceway 28 provides an open passageway which, preferably, is greater than that which could be accommodated within the interior of the fully clad post as, for example, being greater than the width F of a fully clad post, more preferably, greater than that which could be accommodated within twice the width F of a fully clad post.

It is to be appreciated that the invention of the present application in providing the elevated raceway above a partition is adapted for use with partitions having a frame structure other than that as specifically disclosed in this application. Whatever the nature of the wall, the present invention contemplates the wall having a fully clad width and the raceway having an average width and an average height each of which is preferably at least twice the fully clad width of the wall.

While the invention has been described with reference to preferred embodiments, any variations and modifications will now occur to a person skilled in the art. For a definition of the invention, reference is made to the following claims.

I claim:

1. A workspace management system comprising a wall for dividing a room into separate work areas, wherein the wall extends vertically and in a longitudinal direction, the wall having a first side surface, a second side surface, a lower portion and an upper portion above the lower portion, the upper portion having a width defined between the first and second side surfaces over the upper portion greater than a width of the lower portion defined between the first and second side surfaces over the lower portion, an overhead raceway defined within the upper portion between the first surface and the second surface over the upper portion, the lower portion is vertical and has a substantially constant width, the wall comprises a plurality of modular partitions joined together at their ends each comprising:

a rigid frame and a plurality of overlying modular covers coupled to the rigid frame to form the first and second side surfaces over the lower portion and the upper portion, at least some of the modular covers over the lower portion being removable, at least some of the modular covers over the upper portion being removable, the modular covers over the upper portion which are removable being interchangeable with modular covers over the lower portion which are removable, the overhead raceway extending longitudinally of the wall continuously along the wall through each petition and out an end of each partition into adjoining partitions.

2. A system as claimed in claim 1 wherein a coupling arrangement which couples the removable covers to the frame over the upper portion is used to couple the removable covers to the frame over the lower portion.

3. A system as claimed in claim 1 wherein each rigid frame comprises spaced vertical posts at each end of the frame and a plurality of horizontal beams joining the vertical posts, each post having a vertical lower post segment with an upper end, and a bifurcated upper segment with a right-hand side arm member and a left-hand side arm member each extending upwardly from the upper end spaced sideways from each other, the horizontal beams include left-hand side upper beams spanning between the respective left-hand side arm members of the upper segments of adjacent posts and right-hand side upper beams spanning between the respective right-hand side arm members of the upper segments of adjacent posts, the left-hand side arm members and their left-hand side beam members spaced from the right-hand side arm members and their left-hand side beam members to define the elongate raceway therebetween open upwardly above the frame, extending along the length of the frame between vertical posts, and open at each end of the frame for communication out each end of the frame with a raceway of an adjacent identical modular partition.

4. A system as claimed in claim 3 wherein the left-hand side upper beams spanning between the respective left-hand side arm members of the upper segments of adjacent posts are outward of the left-hand side arm members, the right-hand side upper beams spanning between the respective right-hand side arm members of the upper segments of adjacent posts are outward of the right-hand side arm members.

5. A system as claimed in claim 4 wherein the horizontal beams include lower beams spanning between lower segments of adjacent posts with a set of left-hand lower beams outward of the left-hand side of the lower segments, and a set of right-hand lower beams outward of the right-hand side of the lower segments.

6. A system as claimed in claim 5 wherein a vertical passageway is defined internally between the lower segments of the posts and inside of the lower beams and which extends vertically into the overhead raceway.

7. A system as claimed in claim 6 wherein the lower portion is vertical and has a substantially constant width, the overhead raceway is defined within the upper portion between the first surface and the second surface over the upper portions so as to have an average width and average height each at least equal to about twice said constant width.

8. A system as claimed in claim 6 wherein the upper portion is disposed at a height that the upper portion does not impede use of the workspace adjacent the wall.

9. A system as claimed in claim 8 wherein the upper portion is disposed at a height at least five feet above a floor.

10. A system as claimed in claim 1 wherein the side surface over the upper portion on at least one side of the wall extends upwardly and away from the side surface over the upper portion on the other side of the wall.

11. A system as claimed in claim 1 wherein one side surface is disposed as a substantially vertical surface throughout the entire upper portion and lower portion.

12. A system as claimed in claim 1 wherein the wall includes passageways vertically and horizontally through the wall interior of the wall between the first and second side surfaces which passageways are in communication with the overhead raceway for the passage of utilities from the overhead raceway internally into the interior of the wall.

13. A system as claimed in claim 1 wherein each of the side walls of the upper portion extends at an angle of 20° to 45° to the vertical.

14. A system as claimed in 1 wherein each of a plurality of the partitions includes a modular duct member disposed within the overhead raceway, each modular duct member providing an air passageway for air longitudinally through the raceway, each modular duct member having an exit conduit extending from the raceway to the side surface of one side of the wall in the upper portion, one of the modular covers over the upper portion comprising a removable modular cover with an opening therethrough in alignment with the exit conduit to permit passage of air through such cover when the cover is coupled to the frame.

15. A system as claimed in claim 14 including a damper mechanism disposed within the exit conduit.

16. A system as claimed in claim 1 wherein the partition over the lower segment of the post is disposed vertically and has a substantially constant width, the partition above the lower segment of the posts has an average width and average height each at least equal to about twice said constant width.

17. A system as claimed in claim 5 wherein the left-hand side upper beams, the right-hand side upper beams, the left-hand side lower beams and the right-hand side lower beams are all interchangeable.

18. A workspace management system comprising a wall for dividing a room into separate work areas, wherein the wall extends vertically and in a longitudinal direction, the wall having a first side surface, a second side surface, a lower portion and an upper portion above the lower portion, the upper portion having a width defined between the first and second side surfaces over the upper portion greater than a width of the lower portion defined between the first and second side surfaces over the lower portion, an overhead raceway defined within the upper portion between the first surface and the second surface over the upper portion, the overhead raceway extending longitudinally of the wall, the lower portion is vertical and has a substantially constant width, the wall comprises a plurality of nodular partitions joined together at their ends each comprising:

a rigid frame and a plurality of overlying modular covers coupled to the rigid frame to form the first and second side surfaces over the lower portion and the upper portion, at least some of the modular covers over the lower portion being removable, at least some of the modular covers over the upper portion being removable, wherein each rigid frame comprises spaced vertical posts at each end of the frame and a plurality of horizontal beams joining the vertical posts, each post having a vertical lower post segment with an upper end, aid a bifurcated upper segment with a right-hand side arm member and a left-hand side arm member each extending upwardly from the upper end spaced sideways from each other.

19. A system as claimed in claim 18 wherein the left-hand side upper beams spanning between the respective left-hand side arm members of the upper segments of adjacent posts are outward of the left-hand side arm members, the right-hand side upper beams spanning between the respective right-hand side arm members of the upper segments of adjacent posts are outward of the right-hand side arm members, the horizontal beams include lower beams spanning between lower segments of adjacent posts with a set of left-hand lower beams outward of the left-hand side of the lower segments, and a set of right-hand lower beams outward of the right-hand side of the lower segments, and a vertical passageway is defined internally between the lower segments of the posts and inside of the lower beams and which extends vertically into the overhead raceway.

20. A system as claimed in claim 19 wherein each of a plurality of the partitions includes a modular duct member disposed within the overhead raceway, each modular duct member providing an air passageway for air longitudinally through the raceway, each modular duct member having an exit conduit extending from the raceway to the side surface of one side of the wall in the upper portion, one of the modular covers over the upper portion comprising a removable modular cover with an opening therethrough in alignment with the exit conduit to permit passage of air through such cover when the cover is coupled to the frame.

* * * * *